United States Patent [19]

Hepfner et al.

[11] 4,428,830

[45] Jan. 31, 1984

[54] PRECIOUS METALS RECOVERY UNIT

[75] Inventors: Anton Hepfner, 761 Sutter St., Yuba City, Calif. 95991; Dorothy A. Malicki, Yuba City, Calif.

[73] Assignee: Anton Hepfner, Yuba City, Calif.

[21] Appl. No.: 361,227

[22] Filed: Mar. 24, 1982

[51] Int. Cl.[3] ..... B03B 5/58

[52] U.S. Cl. ..... 209/211; 209/459; 209/508

[58] Field of Search ..... 209/201, 211, 459, 461, 209/465, 508; 55/429; 210/244

[56] References Cited

U.S. PATENT DOCUMENTS

| | | | |
|---|---|---|---|
| 641,359 | 1/1900 | Barron | 209/211 |
| 872,555 | 12/1907 | Capps | 209/211 |
| 1,969,619 | 8/1934 | MacLean | 209/465 |
| 2,725,983 | 12/1955 | Rakowsky | 209/211 |
| 4,311,585 | 1/1982 | Bergstrom | 209/211 |

*Primary Examiner*—David L. Lacey

*Attorney, Agent, or Firm*—Lothrop & West

[57] ABSTRACT

A precious metal recovery bowl includes a steep peripheral wall, a floor having an upward and inward shape at a relatively low angle, a centralized frustoconical member having a moderately steep slope and a top central ring with a vertical outer wall terminating in a circular lip and encompassing a central, vertical, overflow channel. A tangential, horizontal nozzle extending through the peripheral wall is connected to a hose which supplies water to the bowl so as to separate a pre-screened mixture of tailings and precious metals located in the bowl.

3 Claims, 2 Drawing Figures

PRECIOUS METALS RECOVERY UNIT

BACKGROUND OF THE INVENTION

Owing to the current high price of gold, silver and other precious metals, part-time, or weekend, miners are again working both hard-rock and placer deposits.

Numerous commercial mines have also been newly opened, enlarged or re-activated.

In all types of mining operations, it becomes necessary to separate the precious metals from the gangue, or tailings.

Although the market place as well as the patent literature, including the Ore Concentrator disclosed in U.S. Pat. No. 872,555, to J. R. Capps, afford examples of devices capable of recovering precious metals while discarding unwanted material, there is still considerable room for improvement.

There is a particular need for a relatively small versatile unit which can readily be carried to and set up at a mining site and used in conjunction with any mining process for the recovery of precious metals from concentrated ore.

SUMMARY OF THE INVENTION

It is therefore an object of the present invention to provide a light, compact and efficient portable unit for recovering precious metals from prescreened ore concentrates of various types. A circular bowl has a centrally located circular opening defined by an axially concentric ring disposed on top of a frusto-conical member with a depending vertical, hollow, right circular cylinder forming a central overflow, or discharge, channel. The peripheral side walls of the bowl descend at a steep angle from the rim of the bowl and intersect the outer perimeter of the bottom of the bowl. From the outer perimeter of the bottom or floor, of the bowl, the bottom ascends inwardly at a relatively low gradient until it intersects the base of a hollow frustum of a cone, at which location the bottom merges with the assumes the relatively steep upward slope of the walls of the frustum. Upon reaching the bottom of the ring the frustum walls terminate and the slope of the wall abruptly becomes vertical and remains vertical to the top of the ring.

Water at relatively high velocity is introduced, horizontally and tangentially, into the bowl along the peripheral side walls to establish a vortex flow which overflows over a circular lip at the top of the vertical wall into the central discharge channel. Previously concentrated ore, containing a mixture of precious metal and gangue, is introduced into the whirlng water in the bowl at suitable intervals and in appropriate quantities to optimize separation resulting from a combination of gravital and centrifugal forces within the swirling pool of water.

A plurality of fin-like legs projects downwardly and radially outwardly below the bowl. The bottom edges of the legs are sloped so that the unit can fit the top of various types of receptacles, such as 5-gallon buckets or drums of different capacities. A quick-connect-disconnect coupling enables the unit to be quickly set up and water flow started. After a suitable batch of ore is processed, the water supply can be shut off, the water hose disconnected and the precious metals recovered from the bowl.

DETAILED DESCRIPTION OF A PREFERRED EMBODIMENT OF THE INVENTION

Figure 1:
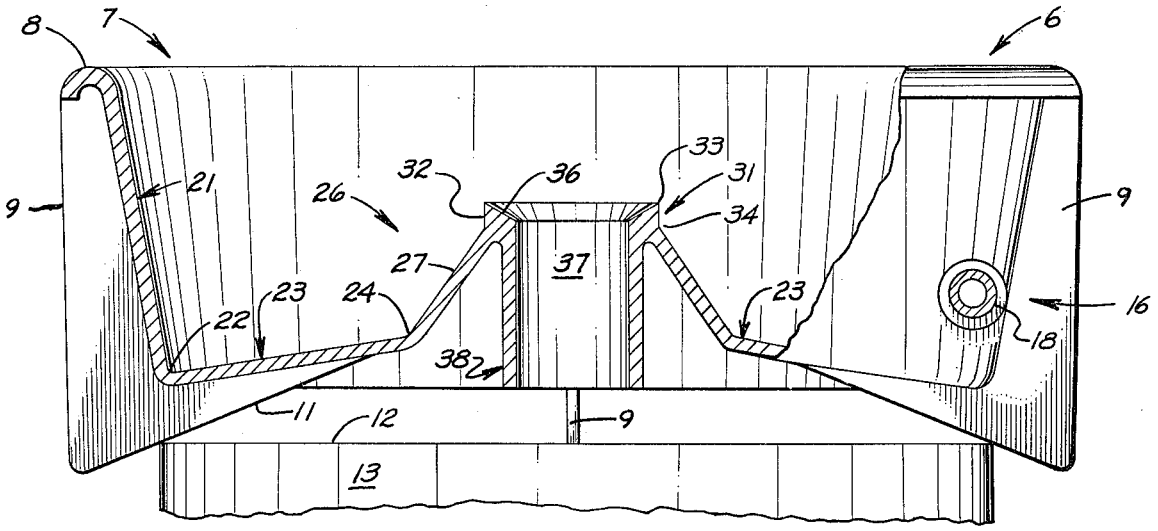
FIG. 1 is a side elevational view, with portions broken away to reveal structural details; and, FIG. 2 is a top plan view, with portions broken away particularly in order to disclose the tangential nozzle fitting for the water hose.
Figure 2:
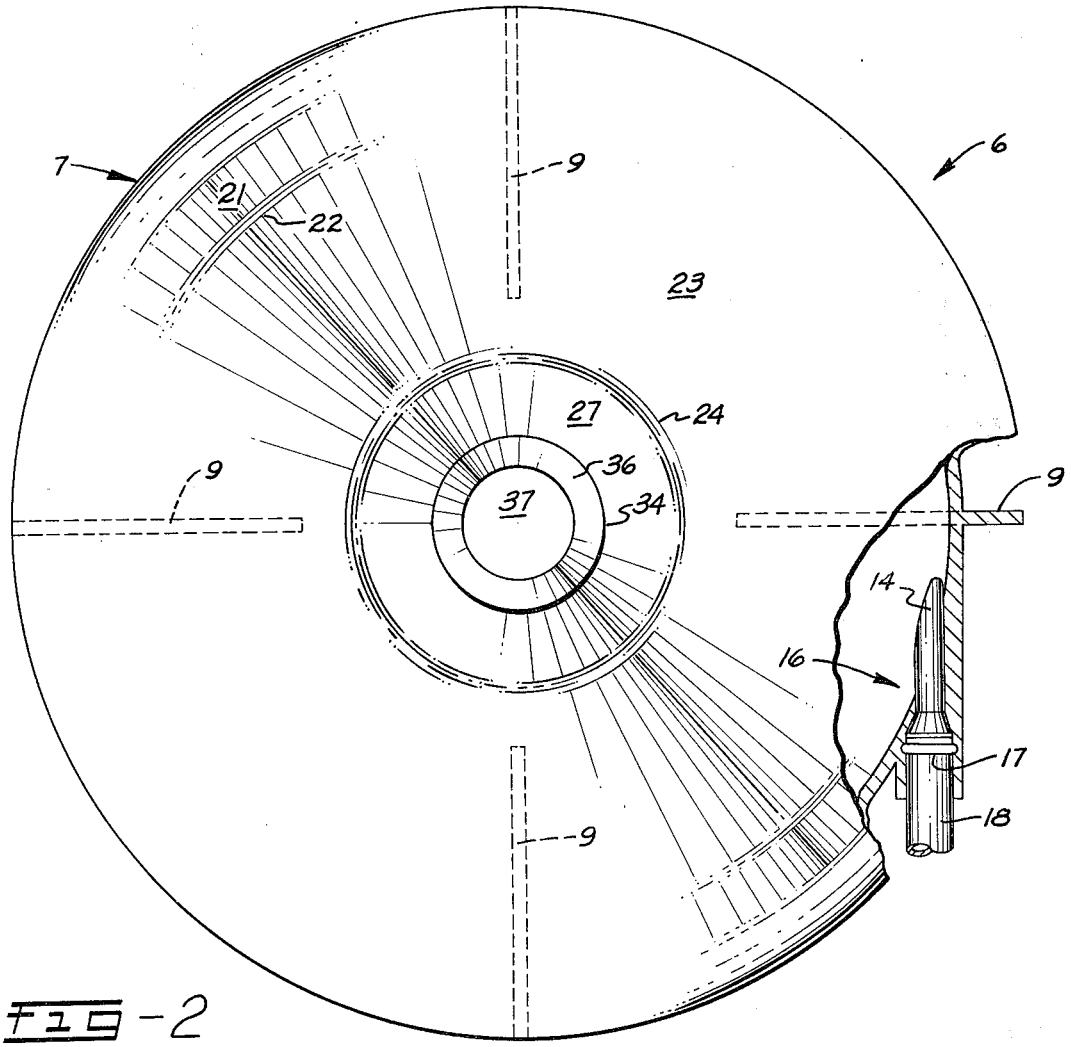

Although the precious metals recovery unit of the invention is susceptible of numerous different physical embodiments, depending on the environment and requirements of use, a unit of the type embodied herein has been made and tested with eminently satisfactory results.

Minor adjustments of water volume and pressure as well as quantity of ore will readily enable even an unskilled person to establish an operating procedure capable of yielding optimum results.

The precious metals recovery unit of the invention, generally designated by the reference numeral 6 includes a circular bowl 7 in plan view having an upper rim 8 recurved to facilitate grasping and lifting.

A plurality of fin-shaped radial supporting legs 9 are shaped so that the lower edges 11 slope upwardly and inwardly to fit the upper rim 12 of a vessel 13, or receptacle, such as a 5-gallon bucket, for example. The shape of the legs facilitates centering the leveling of the bowl 7.

With the bowl 7 firmly supported on the receptacle 13, water is introduced into the bowl through a tangential, horizontal nozzle 14 in a fitting 16 provided with a quick-connect-disconnect coupling 17 for ready attachment with and detachment from a water supply hose 18.

In the event the unit is formed of plastic the nozzle fitting can be molded in the wall as part of the casting, if desired.

From the rim 8, the outer, or peripheral wall 21 of the bowl descends at a steep angle, the base 22 of the wall intersecting and merging with the bottom 23 of the bowl.

From the base 22 of the outer wall 21, the bottom 23 slopes inwardly and upwardly at a small gradient until it intersects and merges with the base 24 of a frustum 26 of a hollow cone. The wall 27 of the frustum 26 is moderately steep and, in conjunction with the steep slope of the outer wall 21 and the low gradient of the bottom 23, not only serves to separate the relatively heavy precious metals from the relatively light tailings but also to segregate the precious metals themselves in accordance with size.

In other words, once the vortex flow is established, by injecting water tangentially into the bowl from the nozzle 14, and the pre-screened ore concentrate is introduced into the bowl, for example at a location where the material is impinged by the relatively high velocity jet emerging from the nozzle, the material tends to fragment and to disperse in the vortex.

Centrifugal force urges the relatively heavy precious metals toward the steep outer peripheral wall 21 of the bowl where the force of gravity causes the larger and heavier particles to descend toward the base 22 of the wall 21 and remain there.

Concurrently, the lighter gangue and the smaller particles of precious metal, being more responsive to the inward components of the vortex, tend to migrate inwardly and upwardly, across the gradually ascending bottom 23, or floor, of the bowl, toward the frustum 26.

Upon reaching the base 24 of the frustum 26, the relatively steep wall 27 encountered by the particles redirects the flow upwardly to a rather sharp degree.

The effect of the change in flow pattern is to differentiate between the lighter gangue material and "fines" (very small-sized particles of precious metals) on the one hand and the intermediate-sized precious metal particles on the other hand.

The latter tend to congregate around the base 24 of the frustum 26 whereas the former ascend with the swirl of the vortex.

In order to impose a hydraulic barrier to the unwanted loss of the smallest particles of precious metal, a ring 31 is mounted on the top of the frustum 26, the outer perimeter of the ring 31 having a vertical wall 32 and terminating in an overflow lip 33. The vertical wall 32 tends to oppose upward movement of both small "fines" and tailings since the vertically downward force of gravity can exert its greatest influence in this configuration. The more hydraulically responsive tailings continue to swirl upwardly and pass over the overflow lip 33 while the small "fines" tend to drift around the base 34 of the vertical ring wall 32 where the ring wall intersects the frustum wall 27.

As the tailings spill over the overflow lip 33 they descend across a downslope 36 and enter a vertical discharge channel 37 defined by a hollow, right circular cylinder 38 depending from the ring 31.

The water and entrained tailings emerge from the channel 37 and fall into the receptacle 13.

On occasions where extraordinarily small particles of precious metals occur in the gangue it may be economically feasible to introduce the contents of the receptacle into a second unit or into the primary unit after the primary unit is cleaned.

Recovery of the precious metals is effected by turning off the water and disconnecting the hose 18 after the vortex has subsided. Emptying of the water in the bowl and recovery of the segregated "values" (precious metal particles) is then attended to.

As previously indicated, the operation of the unit is quickly learned; and after a short period of experimentation with water quantity, nozzle jet velocity and frequency and amount of ore concentrate feed, a yield of substantially 100% is consistently obtained.

We claim:

1. A precious metals recovery unit for processing a mixture of water and pre-screened ore concentrate including gangue and precious metals to remove the tailings and retain the fines and heavier values comprising:

a. a circular bowl including a steep peripheral wall extending downwardly from a rim to a base; and a floor extending from said base inwardly and upwardly at a relatively low gradient to inhibit the inward movement of heavier values collecting at the base of said peripheral wall;

b. a frustum of a vertical hollow cone having a base mounted centrally on said floor, and a wall converging upwardly at a moderately steep angle intermediate the slope of said peripheral wall and the slope of said floor to inhibit the advance of intermediate size particles of precious metal beyond the base of said frustrum;

c. a ring mounted on the upper end of said frustum wall, said ring including a vertical outer perimeter wall terminating at the top in an overflow lip, said vertical perimeter wall allowing gravity to inhibit further upward movement of fines without preventing the tailings from overflowing said lip;

d. a hollow, right circular cylinder mounted on the inner margin of said ring and depending therefrom to define a channel for the discharge of waste material over-flowing said lip of said ring;

e. a nozzle mounted tangentially on and extending through said peripheral wall so as to establish a vortex flow pattern for the water, precious metal particles and tailings within said bowl; and, f. a plurality of support legs mounted on said bowl so as to support said bowl on a receptacle.

2. A precious metals recovery unit as in claim 1 in which said legs are radially arranged fins, the bottom edges of which are sloped upwardly and inwardly to fit the upper rim of a supporting receptacle.

3. A precious metals recovery unit as in claim 2 in which said bowl, said cylinder and said legs are molded of plastic material.

* * * * *